US007638476B2

(12) United States Patent
Orlich et al.

(10) Patent No.: US 7,638,476 B2
(45) Date of Patent: Dec. 29, 2009

(54) WASHING AND CLEANING AGENTS COMPRISING READILY SOLUBLE CAPSULES

(75) Inventors: Bernhard Orlich, Düsseldorf (DE); Bernd Richter, Leichlingen (DE); Sören Hölsken, Düsseldorf (DE); Stefan Van Der Burgh, Bedburg (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 4 days.

(21) Appl. No.: 12/028,389

(22) Filed: Feb. 8, 2008

(65) Prior Publication Data

US 2008/0214428 A1 Sep. 4, 2008

Related U.S. Application Data

(63) Continuation of application No. PCT/EP2006/007149, filed on Jul. 20, 2006.

(30) Foreign Application Priority Data

Aug. 10, 2005 (DE) ..... 10 2005 038 070

(51) Int. Cl.
*C11D 7/14* (2006.01)
*C11D 17/02* (2006.01)

(52) U.S. Cl. ..... 510/441; 510/142; 510/143; 510/276; 510/296; 510/326; 510/349; 510/438; 510/508; 510/485; 510/486; 510/507; 510/523; 510/532

(58) Field of Classification Search ..... 510/142, 510/143, 276, 296, 326, 349, 438, 441, 508, 510/485, 486, 507, 523, 532
See application file for complete search history.

(56) References Cited

U.S. PATENT DOCUMENTS

| | | | | |
|---|---|---|---|---|
| 6,183,665 | B1 * | 2/2001 | Blondeau et al. | 252/186.39 |
| 6,855,681 | B1 | 2/2005 | Ness et al. | |
| 2001/0025020 | A1 | 9/2001 | Holderbaum et al. | |
| 2004/0033269 | A1 * | 2/2004 | Hei et al. | 424/616 |
| 2005/0169984 | A1 * | 8/2005 | Nomura et al. | 424/456 |
| 2005/0205574 | A1 * | 9/2005 | Lambotte et al. | 220/234 |
| 2007/0256251 | A1 | 11/2007 | Orlich et al. | |
| 2008/0261857 | A1 * | 10/2008 | Orlich et al. | 510/445 |

FOREIGN PATENT DOCUMENTS

| | | | |
|---|---|---|---|
| DE | 199 59 875 | A1 | 7/2001 |
| DE | 102 05 872 | A1 | 3/2003 |
| DE | 102 59 848 | A1 | 7/2004 |
| EP | 0 087 035 | A1 | 8/1983 |
| EP | 0 133 562 | A2 | 2/1985 |
| WO | WO 00/36066 | | 6/2000 |
| WO | WO 2006/034758 | A1 | 4/2006 |

OTHER PUBLICATIONS

German Office Action dated May 5, 2006 for DE 10 2005 038 070.0.

* cited by examiner

*Primary Examiner*—Charles I Boyer
(74) *Attorney, Agent, or Firm*—RatnerPrestia

(57) ABSTRACT

Aqueous washing and cleaning agents that contain capsules in addition to other constituents, the capsules each encompassing an active ingredient in a matrix. The introduction of a combination of aluminum silicate and silicic acid into the matrix improves the solubility characteristics of the capsules in a washing operation.

25 Claims, No Drawings

WASHING AND CLEANING AGENTS COMPRISING READILY SOLUBLE CAPSULES

CROSS-REFERENCE TO RELATED APPLICATIONS

This application is a continuation under 35 U.S.C. §§ 120 and 365(c) of international application PCT/EP2006/007149, filed on Jul. 20, 2006. This application also claims priority under 35 U.S.C. § 119 of DE 10 2005 038 070, filed on Aug. 10, 2005.

BACKGROUND OF THE INVENTION

The invention relates to an aqueous liquid washing and cleaning agent containing surfactant(s) as well as further usual ingredients of washing and cleaning agents. The invention also relates to a method for manufacturing an aqueous liquid washing and cleaning agent, and to the use of the aqueous liquid washing and cleaning agent.

The incorporation of certain active substances (e.g. bleaching agents, enzymes, perfumes, dyes, etc.) into liquid washing and cleaning agents can lead to problems. Incompatibilities can occur, for example, between the individual active-substance components of the liquid washing and cleaning agents. This can result in undesirable discoloration, agglomeration, odor problems, and the destruction of active substances having washing activity.

The consumer, however, demands liquid washing and cleaning agents that perform their function optimally at the time of use, even after storage and transport. This requires that the ingredients of the liquid washing and cleaning agent not previously have settled, decomposed, or volatilized.

The loss of volatile components can be prevented, for example, by means of complex and correspondingly expensive packages. Chemically incompatible components can be stored separately from the remaining components of the liquid washing and cleaning agent, and then metered in for use. The utilization of non-transparent packages prevents the breakdown of light-sensitive components, but also has the disadvantage that the consumer cannot see the appearance and quantity of the liquid washing and cleaning agent.

One concept for the incorporation of sensitive, chemically or physically incompatible, and volatile ingredients consists in the use of capsules in which said ingredients are enclosed. A distinction is made between two types of capsules: on the one hand there are capsules having a core-shell structure, in which the ingredient is surrounded by a wall or barrier. On the other hand there are capsules in which the ingredient is distributed in a matrix made of a matrix-forming material. Such capsules are also referred to as "speckles."

U.S. Pat. No. 6,855,681 discloses a cleaning-agent composition that encompasses a matrix-encapsulated active ingredient. The matrix of the capsules contains a hydrated anionic gum, and the encapsulated active ingredient is by preference a fragrance.

When capsules are used in washing and cleaning agents, it is important that the capsules dissolve during the washing operation and leave no residues on the laundry. This is a problem in some cases, however, in particular in the context of critical washing parameters such as cold-water laundering or for wool-washing cycles.

It is therefore an object of the present invention to make available a washing and cleaning agent having improved capsules having at least one active ingredient contained therein, such that the capsules, in particular, dissolve particularly readily and leave no residues on the laundry.

DESCRIPTION OF THE INVENTION

This object is achieved by an aqueous liquid washing and cleaning agent containing surfactant(s) as well as further usual ingredients of washing and cleaning agents, in which the agent contains at least one capsule, the capsule encompassing an active ingredient, an aluminum silicate, and a silicic acid in a matrix, the aluminum silicate and the silicic acid being present at a ratio from 1:10 to 10:1. The aluminum silicate and the silicic acid are present by preference at a ratio from 1:4 to 4:1, and particularly preferably 2:3 to 4:3.

Surprisingly, the solubility behavior of the capsules is improved by the introduction of a combination of aluminum silicate and silicic acid into the matrix. The capsules according to the present invention dissolve without residue even in the critical wool-washing cycle.

In addition, the combination of the two substances also imparts a robust structure to the capsules, and thus has a positive effect on the capsules' stability.

It is preferred that the active ingredient be selected from the group encompassing optical brighteners, surfactants, complexing agents, bleaching agents, bleach activators, dyes, fragrances, antioxidants, detergency builders, enzymes, enzyme stabilizers, antimicrobial active substances, graying inhibitors, pH adjusting agents, soil release polymers, color transfer inhibitors, electrolytes, conditioning oils, abrasive material, skin-care agents, foam inhibitors, vitamins, proteins, preservatives, washing power intensifiers, luster agents, and UV absorbers. Where the active ingredient in the matrix comprises a surfactant, that surfactant may constitute the surfactant forming the basic surfactant present in the liquid washing or cleaning agent, or it may be a surfactant in addition to the basic surfactant present in the agent.

Encapsulation of the ingredients allows the compounds that are important for the primary and secondary washing and cleaning performance of a washing and cleaning agent to be introduced into liquid washing and cleaning agents without resulting in undesirable interactions with other constituents (agglomeration, decomposition, discoloration or loss of color, etc.) or undesirable effects (phase separation, clouding, flocculation, etc.).

In a preferred embodiment, the capsule additionally contains at least one hollow microsphere.

The hollow microspheres have by preference a diameter from 2 to 500 μm, in particular from 5 to 20 μm, and a specific gravity of less than 1 $g \cdot cm^{-3}$. By incorporating one or more hollow microspheres into the respective capsules, the density of the capsules can be adapted to the density of the surrounding washing- and cleaning-agent composition, and undesirable settling or floating (creaming) of the capsules can thus be prevented.

It is also preferred that the matrix is selected from a material from the group encompassing carrageenan, alginate, and gellan gum.

These materials can be crosslinked particularly readily with cations to yield crosslinked insoluble gels. Spherical capsules containing a matrix can easily be manufactured by dripping solutions of these materials into cation-containing solutions.

In a preferred embodiment, the washing and cleaning agent contains dispersed capsules whose diameter along their greatest physical extension is 0.01 to 10,000 μm.

The invention also claims the use of a washing and cleaning agent according to the present invention for cleaning textile fabrics.

Also disclosed is a method for manufacturing an aqueous liquid washing and cleaning agent containing surfactant(s) as well as further usual ingredients of washing and cleaning agents and at least one capsule, the capsule encompassing an active ingredient, an aluminum silicate, and a silicic acid in a matrix, in which method the aluminum silicate and the silicic acid are used at a ratio from 1:10 to 10:1. Where the active ingredient encapsulated in the matrix is a surfactant, that surfactant may constitute the surfactant forming the basic surfactant present in the liquid washing or cleaning agent, or it may be a surfactant in addition to the basic surfactant present in the agent.

The invention also relates to a capsule encompassing an active ingredient, an aluminum silicate, and a silicic acid in a matrix, in which capsule the matrix contains the aluminum silicate and the silicic acid at a ratio from 1:10 to 10:1, and to the use of aluminum silicate and silicic acid at a ratio from 1:10 to 10:1 in a capsule encompassing an active ingredient, an aluminum silicate, and a silicic acid in a matrix, in order to improve the solubility of the capsule.

The washing and cleaning agents according to the present invention are described below in detail with reference, inter alia, to examples.

The washing and cleaning agents according to the present invention contain as a mandatory ingredient at least one capsule encompassing at least one active ingredient in a matrix.

The matrix of the capsule can encompass, for example, carrageenan, alginate, or gellan gum. These materials can be crosslinked with the aid of mono- or polyvalent cations to yield gels.

Alginate is a naturally occurring salt of alginic acid, and occurs in all brown algae (Phaeophycea) as a cell wall constituent. Alginates are acid, carboxy group-containing polysaccharides having a relative molecular weight $M_R$ of approximately 200,000, made up of D-mannuronic acid and L-guluronic acid at various ratios, linked with 1,4-glycoside bonds. The sodium, potassium, ammonium, and magnesium alginates are water-soluble. The viscosity of alginate solutions depends, among other factors, on molar weight and on the counterion. Calcium alginates, for example, form thermally irreversible gels at certain molar ratios. Sodium alginates yield very viscous solutions with water, and can be crosslinked by interaction with di- or trivalent metal ions such as $Ca^{2+}$. Ingredients that are also contained in the aqueous sodium alginate solution are thus enclosed in an alginate matrix.

Carrageenan is an extract from the red algae of the Floridea group (*Chondrus crispus* and *Gigartina stellata*). Carrageenan crosslinks in the presence of $K^+$ ions or $Ca^{2+}$ ions.

Gellan gum is an unbranched anionic microbial heteroexopolysaccharide having a tetrasaccharide basic unit made up of glucose, glucuronic acid, and rhamnose as monomers, approximately every basic unit being esterified with an L-glycerate and every second basic unit with an acetate. Gellan gum crosslinks in the present of $K^+$ ions, $Na^+$ ions, $Ca^{2+}$ ions, or $Mg^{2+}$ ions. Of the materials recited for the matrix, alginate is preferred.

Sensitive, chemically or physically incompatible, and volatile components (=active substances) of the aqueous liquid washing and cleaning agent can be enclosed in the capsule in a manner that is stable in storage and transport. These components are referred to in the context of this invention as "active ingredients." For example, optical brighteners, surfactants, complexing agents, bleaching agents, bleach activators, dyes, fragrances, antioxidants, detergency builders, enzymes, enzyme stabilizers, antimicrobial active substances, graying inhibitors, pH adjusting agents, soil release polymers, color transfer inhibitors, electrolytes, conditioning oils, abrasive material, skin-care agents, foam inhibitors, vitamins, proteins, preservatives, washing power intensifiers, luster agents, and UV absorbers can be present in the capsules. The capsules can contain one or more active ingredient(s).

Advantageously, soil release polymers can be introduced into the capsules as active ingredients. Soil release polymers are usually polymers that substantially comprise ethylene terephthalate and/or polyethylene glycol terephthalate groups. These polymers cannot, however, be arbitrarily formulated, and extended storage and/or severe temperature fluctuations thus result in demixing, which can lead to cloudy products. This problem can be circumvented by encapsulating the soil release polymers. Examples of suitable soil release polymers that can be encapsulated without difficulty include those sold under the names Marloquest L 235 M (from Sasol), Repelotex® SRP6 (from Rhodia), or Präpagen HY (from Clariant).

A further advantageously encapsulated ingredient is enzymes. Enzymes are readily decomposed by other constituents of the washing and cleaning agent. This can be prevented by encapsulating the enzymes. Enzymes that are suitable for encapsulation include, for example, proteases, esterases, lipases, amylases, oxidases, or cellulases.

In the case of smaller molecules constituting an active ingredient, it can be preferable for the active ingredient to be immobilized in order to prevent bleeding out of the capsule. An enzyme, for example, can be immobilized by being attached to a substrate, and introduced into the capsule in the form of an enzyme-substrate complex. When a cellulase is encapsulated, for example, cellulose can be used as a substrate.

The quantity of active ingredient in the aqueous matrix solution is by preference between 0.01 and 40 wt %, more preferably between 0.05 and 20 wt %, particularly preferably between 0.1 and 5 wt %, and especially preferably between 0.5 and 1.5 wt %.

The capsules according to the present invention furthermore contain a combination of aluminum silicate and silicic acid, the ratio being between 1:10 and 10:1, by preference between 1:4 and 4:1, and very particularly preferably between 2:3 and 4:3. For incorporation of these compounds, the corresponding materials are added to the matrix solution. Suitable silicic acids are commercially obtainable under the names Aerosil® or Sipernat® (both from Degussa). The aluminum silicate is by preference a zeolite. Zeolite A, zeolite P, zeolite X, or mixtures thereof can be used. Suitable zeolites include, for example, commercial products sold under the names Wessalith® (from Degussa), Zeolite MAP® (from Crosfield), or VEGOBOND AX (from Sasol).

The quantity of silicic acid and of aluminum silicate in the aqueous matrix solution is by preference respectively between 0.1 and 20 wt %, more preferably between 1 and 10 wt %, and especially preferably between 2 and 10 wt %.

The capsules can additionally contain hollow microspheres. Hollow microspheres are particles having a diameter from 2 to 500 μm, in particular from 5 to 20 μm, and a specific gravity less than 1 $g \cdot cm^{-3}$. Usefully, the hollow microspheres are round and smooth. The hollow microspheres can be made of inorganic material such as water glass, aluminum silicate, borosilicate glass, soda lime glass, or a ceramic, or from organic polymers such as, for example, homo- or copolymers of styrene, acrylonitrile, and vinylidene chloride. Suitable hollow microspheres are available commercially, for example under the names Fillite® (from Trelleborg Fillite), Expancel® (from Akzo Nobel), Scotchlite® (from 3M), Dualite® (from Sovereign Specialty Chemicals), Sphericel® (from Potters Industries), Zeeospheres® (from 3M), Q-Cel® (from PQ Corporation), or Extendospheres® (from PQ Corporation). Further suitable hollow microspheres are offered by Omega Minerals under the product designation E-Spheres. E-Spheres are white ceramic hollow microspheres that are offered in a variety of particle sizes, particle size distributions, bulk weights, and bulk volumes. Many of the aforesaid hollow microspheres are chemically inert and, after destruction of the capsules, are dispersed in the washing liquor and then removed therewith.

As already mentioned above, the density of the capsules can be varied or adjusted by incorporating hollow microspheres. The quantity of hollow microspheres in a capsule depends on the desired density of the capsule. It is preferred, however, for the quantity of hollow microspheres in the aqueous matrix solution to be by preference between 0 and 10 wt %, more preferably between 1 and 5 wt %, and especially preferably between 2 and 4 wt %.

The capsules can have any shape within manufacturing-related limits, but preferably are approximately spherical. Their diameter along their greatest physical extension can be between 0.01 μm (not visually recognizable as capsules) and 10,000 μm, depending on their application and the components contained in their interior. Visible microcapsules, having a diameter in the range from 100 μm to 7,000 μm, in particular from 400 μm to 5,000 μm, are preferred.

For aesthetic reasons, it may be desirable for the capsules to be colored. The capsule can contain for that purpose one or more coloring agents such as a pigment or a dye. It may also be preferred for the capsule to contain a preservative.

For manufacture of the capsules according to the present invention, by preference an aqueous matrix solution that also contains the active ingredient or ingredients to be incorporated, the aluminum silicate, and the silicic acid, as well as optionally further components such as, for example, hollow microspheres, preservatives, and/or coloring agents, is dripped into and then hardened in a precipitation bath containing $Ca^{2+}$ ions. The precipitation bath can contain further ingredients such as a preservative or polydiallyldimethylammonium chloride. The aqueous matrix solution is by preference an alginate solution.

The capsules can be manufactured, for example, by means of a drip processing unit of Rieter Automatik GmbH. Drip processing of the aqueous matrix solution that contains the active ingredient to be incorporated, aluminum silicate, and silicic acid, as well as optionally hollow microspheres, preservatives, and/or coloring agents, is performed by imparting a vibration that is generated with the aid of an oscillating membrane. Droplets are detached as a result of the elevated shear action as the membrane oscillates back. Drip processing itself can be performed, for example, through a single nozzle or through a nozzle plate having 10 to 500, by preference 50 to 100 openings. The nozzles by preference comprise openings having a diameter in the range from 0.2 to 2, by preference 0.3 to 0.8 mm. Drip processing can be performed in principle into a precipitation bath that is designed as an agitated container or vessel. The risk exists in this context, however, that capsules may strike and stick to one another. In addition, capsules and the incorporated active ingredient can be destroyed again during agitation, since the agitation process also causes an undesired temperature rise due to the input of energy. These disadvantages can be avoided if the precipitation bath is embodied as a kind of flow conduit. Drip processing is performed into a uniform flow that conveys the droplets out of the drip zone so quickly that they cannot be struck by, and stick to, subsequent droplets. The capsules float as long as they are not completely hardened; as hardening proceeds, they sediment.

Other drip processing units that differ by having different droplet formation technologies can also be used as alternative manufacturing methods. Examples that may be mentioned here are units made by the Gouda, Cavis, or GeniaLab companies.

The quantity of matrix-forming substance in the aqueous matrix solution is by preference between 0.01 and 10 wt %, particularly preferably between 0.1 and 5 wt %, and especially preferably between 1 and 3 wt %. By preference, sodium alginate is used as a matrix-forming substance.

It may be advantageous for the capsules subsequently to be washed with water, and then to be washed in an aqueous solution having a complexing agent such as, for example, a phosphonate, in order to wash out free $Ca^{2+}$ ions, which can enter into undesired interactions with ingredients of the liquid washing and cleaning agent, e.g. the fatty acid soaps. A suitable phosphonate can be, for example, Dequest® phosphonate of the Solutia company. The capsules are then washed again with water to remove excess complexing agent.

The capsules can be dried before use in a washing and cleaning agent, but preferably they are used moist.

Release of the active ingredient from the capsules usually occurs, during utilization of the agents containing them, by destruction of the matrix as a result of a mechanical, thermal, chemical, and/or enzymatic action. In a preferred embodiment of the invention, the liquid washing and cleaning agents contain identical or different capsules in quantities from 0.01 to 10 wt %, in particular 0.2 to 8 wt %, and extremely preferably 0.5 to 5 wt %.

In addition to the capsules, the liquid washing and cleaning agents contain surfactant(s); anionic, nonionic, cationic, and/or amphoteric surfactants can be used. From an applications-engineering standpoint, mixtures of anionic and nonionic surfactants are preferred. The total surfactant content of the liquid washing and cleaning agent is by preference below 40 wt % and particularly preferably below 35 wt %, based on the entire liquid washing and cleaning agent.

The nonionic surfactants used are preferably alkoxylated, advantageously ethoxylated, in particular primary alcohols having by preference 8 to 18 carbon atoms and an average of 1 to 12 mol ethylene oxide (EO) per mol of alcohol, in which the alcohol radical can be linear or preferably methyl-branched in the 2-position, or can contain mixed linear and methyl-branched radicals, such as those that are usually present in oxo alcohol radicals. Particularly preferred, however, are alcohol ethoxylates having linear radicals made up of alcohols of natural origin having 12 to 18 carbon atoms, e.g. from coconut, palm, tallow, or oleyl alcohol, and an average of 2 to 8 EO per mol of alcohol. The preferred ethoxylated alcohols include, for example, $C_{12-14}$ alcohols with 3 EO or 4 EO, $C_{9-11}$ alcohol with 7 EO, $C_{13-15}$ alcohols with 3 EO, 5 EO, 7 EO, or 8 EO, $C_{12-18}$ alcohols with 3 EO, 5 EO, or 7 EO, and mixtures thereof, such as mixtures of $C_{12-14}$ alcohol with 3 EO and $C_{12-18}$ alcohol with 5 EO. The degrees of ethoxylation indicated represent statistical averages, which can be an integer or a fraction for a specific product. Preferred alcohol ethoxylates exhibit a restricted distribution of homologs (narrow range ethoxylates, NRE). In addition to these nonionic surfactants, fatty alcohols with more than 12 EO can also be used. Examples of these are tallow fatty alcohols with 14 EO, 25 EO, 30 EO, or 40 EO. Nonionic surfactants that contain EO and PO groups together in the molecule are also usable according to the present invention. Block copolymers having EO-PO block units or PO-EO block units, but also EO-PO-EO copolymers or PO-EO-PO copolymers, can be used in this context. Also usable, of course, are mixed alkoxylated nonionic surfactants in which EO and PO units are distributed statistically rather than in block fashion. Such products are obtainable by the simultaneous action of ethylene oxide and propylene oxide on fatty alcohols.

Also usable as further nonionic surfactants are alkyl glycosides of the general formula $RO(G)_x$, in which R denotes a primary straight-chain or methyl-branched (in particular methyl-branched in the 2-position) aliphatic radical having 8 to 22, by preference 12 to 18 carbon atoms; and G is the symbol denoting a glycose unit having 5 or 6 carbon atoms, preferably glucose. The degree of oligomerization x, which indicates the distribution of monoglycosides and oligoglycosides, is any number between 1 and 10; by preference, x is between 1.2 and 1.4.

A further class of nonionic surfactants used in preferred fashion, which are used either as the only nonionic surfactant or in combination with other nonionic surfactants, is alkoxylated, preferably ethoxylated or ethoxylated and propoxylated, fatty acid alkyl esters, by preference having 1 to 4 carbon atoms in the alkyl chain.

Nonionic surfactants of the amine oxide type, for example N-cocalkyl-N,N-dimethylamine oxide and N-tallowalkyl-N,N-dihydroxyethylamine oxide, and the fatty acid alkanolamides, can also be suitable. The quantity of these nonionic surfactants is by preference no more than that of the ethoxylated fatty alcohols, in particular no more than half thereof.

Further suitable surfactants are polyhydroxy fatty acid amides of formula (2)

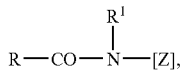

(2)

in which RCO denotes an aliphatic acyl radical having 6 to 22 carbon atoms; $R^1$ denotes hydrogen, an alkyl or hydroxyalkyl radical having 1 to 4 carbon atoms; and [Z] denotes a linear or branched polyhydroxyalkyl radical having 3 to 10 carbon atoms and 3 to 10 hydroxyl groups. The polyhydroxy fatty acid amides are known substances that can usually be obtained by reductive amination of a reducing sugar with ammonia, an alkylamine, or an alkanolamine, and subsequent acylation with a fatty acid, a fatty acid alkyl ester, or a fatty acid chloride.

Also belonging to the group of the polyhydroxy fatty acid amides are compounds of the following formula (3)

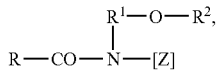

(3)

in which R denotes a linear or branched alkyl or alkenyl radical having 7 to 12 carbon atoms; $R^1$ denotes a linear, branched, or cyclic alkyl radical or an aryl radical having 2 to 8 carbon atoms; and $R^2$ denotes a linear, branched, or cyclic alkyl radical or an aryl radical or an oxyalkyl radical having 1 to 8 carbon atoms, $C_{1-4}$ alkyl or phenyl radicals being preferred; and [Z] denotes a linear polyhydroxyalkyl radical whose alkyl chain is substituted with at least two hydroxyl groups, or alkoxylated, preferably ethoxylated or propoxylated, derivatives of that radical.

[Z] is preferably obtained by reductive amination of a sugar, for example glucose, fructose, maltose, lactose, galactose, mannose, or xylose. The N-alkoxy- or N-aryloxy-substituted compounds can be converted into the desired polyhydroxy fatty acid amides by reaction with fatty acid methyl esters in the presence of an alkoxide as catalyst.

The nonionic surfactant content of the liquid washing and cleaning agents is preferably 5 to 30 wt %, by preference 7 to 20 wt %, and in particular 9 to 15 wt %, based in each case on the entire agent.

Anionic surfactants that can be used are, for example, those of the sulfonate and sulfate types. Possibilities as surfactants of the sulfonate type are, by preference, $C_{9-13}$ alkylbenzenesulfonates, olefinsulfonates, i.e. mixtures of alkene- and hydroxyalkanesulfonates, and disulfonates, for example such as those obtained from $C_{12-18}$ monoolefins having an end-located or internal double bond, by sulfonation with gaseous sulfur trioxide and subsequent alkaline or acid hydrolysis of the sulfonation products. Also suitable are alkanesulfonates that are obtained from $C_{12-18}$ alkanes, for example by sulfochlorination or sulfoxidation with subsequent hydrolysis and neutralization. The esters of α-sulfo fatty acids (estersulfonates), e.g. the α-sulfonated methyl esters of hydrogenated coconut, palm kernel, or tallow fatty acids, are likewise suitable.

Further suitable anionic surfactants are sulfonated fatty acid glycerol esters. "Fatty acid glycerol esters" are understood as the mono-, di- and triesters, and mixtures thereof, that are obtained during the production by esterification of a monoglycerol with 1 to 3 mol fatty acid, or upon transesterification of triglycerides with 0.3 to 2 mol glycerol. Preferred sulfonated fatty acid glycerol esters are the sulfonation products of saturated fatty acids having 6 to 22 carbon atoms, for example hexanoic acid, octanoic acid, decanoic acid, myristic acid, lauric acid, palmitic acid, stearic acid, or behenic acid.

Preferred alk(en)yl sulfates are the alkali, and in particular sodium, salts of the sulfuric acid semi-esters of the $C_{12}$-$C_{18}$ fatty alcohols, for example from coconut fatty alcohol, tallow fatty alcohol, lauryl, myristyl, cetyl, or stearyl alcohol, or the $C_{10}$-$C_{20}$ oxo alcohols, and those semi-esters of secondary alcohols of those chain lengths. Additionally preferred are alk(en)yl sulfates of the aforesaid chain length that contain a synthetic straight-chain alkyl radical produced on a petrochemical basis, which possess a breakdown behavior analogous to those appropriate compounds based on fat-chemistry raw materials. For purposes of washing technology, the $C_{12}$-$C_{16}$ alkyl sulfates and $C_{12}$-$C_{15}$ alkyl sulfates, as well as $C_{14}$-$C_{15}$ alkyl sulfates, are preferred. 2,3-alkyl sulfates that can be obtained, as commercial products of the Shell Oil Company, under the name DAN®, are also suitable anionic surfactants.

The sulfuric acid monoesters of straight-chain or branched $C_{7-21}$ alcohols ethoxylated with 1 to 6 mol ethylene oxide, such as 2-methyl-branched $C_{9-11}$ alcohols with an average of 3.5 mol ethylene oxide (EO) or $C_{12-18}$ fatty alcohols with 1 to 4 EO, are also suitable. Because of their high foaming characteristics they are used in cleaning agents only in relatively small quantities, for example in quantities from 1 to 5 wt %.

Other suitable anionic surfactants are also the salts of alkylsulfosuccinic acid, which are also referred to as sulfosuccinates or as sulfosuccinic acid esters and represent the monoesters and/or diesters of sulfosuccinic acid with alcohols, preferably fatty alcohols, and in particular ethoxylated fatty alcohols. Preferred sulfosuccinates contain $C_{8-18}$ fatty alcohol radicals or mixtures thereof. Particularly preferred sulfosuccinates contain a fatty alcohol radical that is derived from ethoxylated fatty alcohols which, considered per se, represent nonionic surfactants (see below for description). Sulfosuccinates whose fatty alcohol radicals derive from ethoxylated fatty alcohols having a restricted homolog distribution are, in turn, particularly preferred. It is likewise also possible to use alk(en)ylsuccinic acid having by preference 8 to 18 carbon atoms in the alk(en)yl chain, or salts thereof.

Soaps are particularly preferred anionic surfactants. Saturated and unsaturated fatty acid soaps, such as the salts of lauric acid, myristic acid, palmitic acid, stearic acid, (hydrogenated) erucic acid, and behenic acid, are suitable, as are soap mixtures derived in particular from natural fatty acids, e.g. coconut, palm kernel, olive oil, or tallow fatty acids.

The anionic surfactants, including the soaps, can be present in the form of their sodium, potassium, or ammonium salts, and as soluble salts of organic bases, such as mono-, di-, or triethanolamine. The anionic surfactants are preferably present in the form of their sodium or potassium salts, in particular in the form of the sodium salts.

The anionic surfactant content of preferred liquid washing and cleaning agents is 2 to 30 wt %, by preference 4 to 25 wt %, and in particular 5 to 22 wt %, based in each case on the entire agent.

The viscosity of the liquid washing and cleaning agents can be measured with usual standard methods (for example, Brookfield LVT-II viscosimeter at 20 rpm and 20° C., spindle 3), and is by preference in the range from 500 to 5000 mPas. Preferred agents have viscosities from 700 to 4000 mPas, values between 1000 and 3000 mPas being particularly preferred.

In addition to the capsules and the surfactant(s), the liquid washing and cleaning agents can contain further ingredients that further improve the applications—engineering and/or aesthetic properties of the liquid washing and cleaning agent. In the context of the present invention, preferred agents contain, in addition to the capsules and the surfactant(s), one or more substances from the group of the detergency builders, bleaching agents, bleach activators, enzymes, electrolytes, non-aqueous solvents, pH adjusting agents, fragrances, perfume carriers, fluorescing agents, dyes, hydrotopes, foam inhibitors, silicone oils, anti-redeposition agents, optical brighteners, graying inhibitors, shrinkage preventers, crease-prevention agents, color transfer inhibitors, antimicrobial active substances, germicides, fungicides, antioxidants, corrosion inhibitors, antistatic agents, ironing adjuvants, proofing and impregnation agents, swelling and anti-slip agents, and UV absorbers.

Silicates, aluminum silicates (in particular zeolites), carbonates, salts of organic di- and polycarboxylic acids, and mixtures of these substances, may be mentioned in particular as detergency builders that can be contained in the liquid washing and cleaning agents.

Suitable crystalline, sheet-form sodium silicates possess the general formula $NaMSi_xO_{2x+1}.H_2O$, where M denotes sodium or hydrogen, x is a number from 1.9 to 4, and y is a number from 0 to 20, and preferred values for x are 2, 3, or 4. Preferred crystalline sheet silicates of the formula indicated above are those in which M denotes sodium and x assumes the value 2 or 3. Both β- and δ-sodium disilicates $Na_2Si_2O_5.yH_2O$ are particularly preferred.

Also usable are amorphous sodium silicates having a $Na_2O:SiO_2$ modulus of 1:2 to 1:3.3, by preference 1:2 to 1:2.8, and in particular 1:2 to 1:2.6, which are dissolution-delayed and exhibit secondary washing properties. A dissolution delay as compared with conventional amorphous sodium silicates can have been brought about in various ways, for example by surface treatment, compounding, compacting/densification, or overdrying. In the context of this invention, the term "amorphous" is also understood to mean "X-amorphous." In other words, in X-ray diffraction experiments the silicates yield not the sharp X-ray reflections that are typical of crystalline substances, but at most one or more maxima in the scattered X radiation that have a width of several degree units of the diffraction angle. Particularly good builder properties can, however, very easily be obtained even if the silicate particles yield blurred or even sharp diffraction maxima in electron beam diffraction experiments. This is interpreted to mean that the products have microcrystalline regions 10 to several hundred nm in size, values of up to a maximum of 50 nm, and in particular a maximum of 20 nm, being preferred. Densified/compacted amorphous silicates, compounded amorphous silicates, and overdried X-amorphous silicates are particularly preferred.

The finely crystalline synthetic zeolite containing bound water is by preference zeolite A and/or zeolite P. Zeolite MAP® (commercial product of the Crosfield Co.) is particularly preferred as zeolite P. Also suitable, however, are zeolite X as well as mixtures of A, X, and/or P. Also commercially available and preferred for use in the context of the present invention is, for example, a co-crystal of zeolite X and zeolite A (approx. 80 wt % zeolite X) that is marketed by the Sasol company under the trade name VEGOBOND AX® and can be described by the formula $$nNa_2O.(1-n)K_2O.Al_2O_3.(2-2.5)SiO_2.(3.5-5.5)H_2O$$

$$n=0.90-1.0$$

The zeolite can be used as a spray-dried powder or also as an undried stabilized suspension still moist as manufactured. In the event the zeolite is used as a suspension, it can contain small additions of nonionic surfactants as stabilizers, for example 1 to 3 wt %, based on the zeolite, of ethoxylated $C_{12}$-$C_{18}$ fatty alcohols with 2 to 5 ethylene oxide groups, $C_{12}$-$C_{14}$ fatty alcohols with 4 to 5 ethylene oxide groups, or ethoxylated isotridecanols. Suitable zeolites exhibit an average particle size of less than 10 μm (volume distribution; measurement method: Coulter Counter), and preferably contain 18 to 22 wt %, in particular 20 to 22 wt %, bound water.

Use of the generally known phosphates as builder substances is also, of course, possible, provided such use is not to be avoided for environmental reasons. The sodium salts of the orthophosphates, the pyrophosphates, and in particular the tripolyphosphates are especially suitable.

Among the compounds yielding $H_2O_2$ in water that serve as bleaching agents, sodium perborate tetrahydrate and sodium perborate monohydrate are of particular importance. Other usable bleaching agents are, for example, sodium percarbonate, peroxypyrophosphates, citrate perhydrates, and peracid salts or peracids that yield $H_2O_2$, such as perbenzoates, peroxyphthalates, diperazelaic acid, phthaloimino peracid, or diperdodecanedioic acid.

Bleach activators can be incorporated into the washing and cleaning agents in order to achieve an improved bleaching effect when washing at temperatures of 60° C. and below. Compounds that, under perhydrolysis conditions, yield aliphatic peroxycarboxylic acids having preferably 1 to 10 carbon atoms, in particular 2 to 4 carbon atoms, and/or optionally substituted perbenzoic acid, can be used as bleach activators. Substances that carry O- and/or N-acyl groups having the aforesaid number of carbon atoms, and/or optionally substituted benzoyl groups, are suitable. Multiply acylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetyl glycoluril (TAGU), N-acylimides, in particular N-nonanoyl succinimide (NOSI), acylated phenolsulfonates, in particular n-nonanoyl or isononanoyl oxybenzenesulfonate (n- and iso-NOBS), carboxylic acid anhydrides, in particular phthalic acid anhydride, acylated polyvalent alcohols, in particular triacetin, ethylene glycol diacetate, and 2,5-diacetoxy-2,5-dihydrofuran, are preferred.

In addition to or instead of the conventional bleach activators, so-called bleach catalysts can also be incorporated into the liquid washing and cleaning agents. These substances are bleach-intensifying transition-metal salts or transition-metal complexes such as, for example, Mn, Fe, Co, Ru, or Mo salt complexes or carbonyl complexes. Mn, Fe, Co, Ru, Mo, Ti, V, and Cu complexes having nitrogen-containing tripod ligands, as well as Co, Fe, Cu, and Ru ammine complexes, are also applicable as bleach catalysts.

The liquid washing and cleaning agent preferably contains a thickening agent. The thickening agent can encompass, for example, a polyacrylate thickener, xanthan gum, gellan gum, guar seed flour, alginate, carrageenan, carboxymethyl cellulose, bentonite, wellan gum, locust bean flour, agar-agar, tragacanth, gum arabic, pectins, polyoses, starch, dextrins, gelatin, and casein. Altered natural substances such as modified starches and celluloses (carboxymethyl cellulose and other cellulose ethers, hydroxyethyl and -propyl cellulose, and seed flour ethers may be mentioned here by way of example) can, however, also be used as thickening agents.

Included among the polyacrylate and polymethacrylate thickeners are, for example, the high-molecular-weight homopolymers of acrylic acid crosslinked with a polyalkenyl polyether, in particular an allyl ether, of sucrose, pentaerythrite, or propylene (INCI name, according to "International Dictionary of Cosmetic Ingredients" of the Cosmetic, Toiletry and Fragrance Association (CFTA): Carbomer), which are also referred to as carboxyvinyl polymers. Polyacrylic acids of this kind are obtained, among other sources, from the 3V Sigma company under the trade name Polygel®, e.g. Polygel DA, and from the B.F. Goodrich company under the trade name Carbopol®, e.g. Carbopol 940 (molecular weight approx. 4,000,000), Carbopol 941 (molecular weight approx. 1,250,000), or Carbopol 934 (molecular weight approx. 3,000,000). Also included thereamong are the following acrylic acid copolymers: (i) copolymers of two or more monomers from the group of acrylic acid, methacrylic acid, and their simple esters, by preference formed with $C_{1-4}$ alkanols (INCI: Acrylates Copolymer), included among which are, for example, the copolymers of methacrylic acid, butyl acrylate, and methyl methacrylate (CAS designation according to Chemical Abstracts Service: 25035-69-2), or of butyl acrylate and methyl methacrylate (CAS 25852-37-3), and which are obtainable, for example, from the Rohm & Haas company under the trade names Aculyn® and Acusol®, and from the Degussa (Goldschmidt) company under the trade name Tego® Polymer, e.g. the anionic nonassociative polymers sold under the names Aculyn 22, Aculyn 28, Aculyn 33 (crosslinked), Acusol 810, Acusol 820, Acusol 823, and Acusol 830 (CAS 25852-37-3); (ii) crosslinked high-molecular-weight acrylic acid copolymers, included among which are, for example, the copolymers, crosslinked with an allyl ether of sucrose or of pentaerythrite, of $C_{10-30}$ alkyl acrylates with one or more monomers from the group of acrylic acid, methacrylic acid, and their simple esters formed preferably with $C_{1-4}$ alkanols (INCI: Acrylates/$C_{10-30}$ Alkyl Acrylate Crosspolymer), and which are obtainable, for example, from the B.F. Goodrich company under the trade name Carbopol®, e.g. the hydrophobized Carbopol ETD 2623 and Carbopol 1382 polymers (INCI: Acrylates/$C_{10-30}$ Alkyl Acrylate Crosspolymer), and Carbopol Aqua 30 polymer (formerly Carbopol EX 473).

A further polymeric thickening agent preferred for use is xanthan gum, a microbial anionic heteropolysaccharide that is produced by *Xanthomonas campestris* and several other species under aerobic conditions, and has a molecular weight from 2 to 15 million dalton. Xanthan is made up of a chain having β-1,4-bound glucose (cellulose) with side chains. The structure of the subgroups is made up of glucose, mannose, glucuronic acid, acetate, and pyruvate; the number of pyruvate units determines the viscosity of the xanthan gum.

Xanthan gum can be described by the following formula (1):

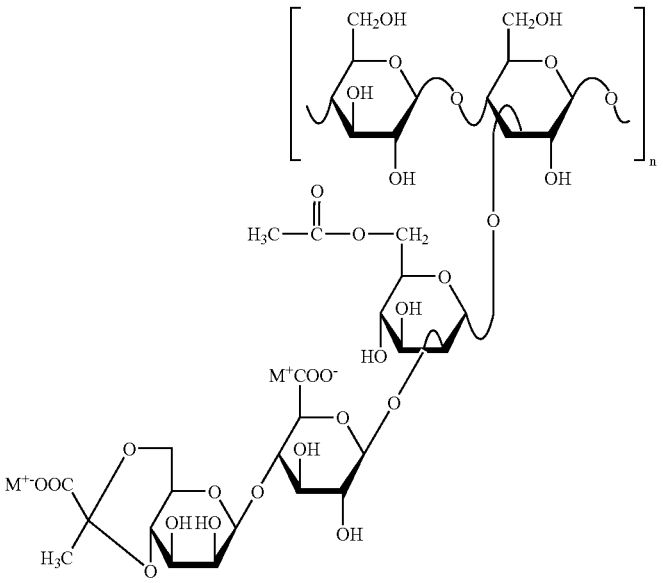

Basic unit of xanthan $M^+$ = Na, K, ½ Ca

Xanthan gum is obtainable, for example, from the Kelco company under the trade names Keltrol® and Kelzan®, or also from the Rhodia company under the trade name Rhodopol®.

Preferred aqueous liquid washing and cleaning agents contain, based on the entire agent, 0.01 to 3 wt %, and by preference 0.1 to 1 wt %, thickening agent. The quantity of thickening agent used depends on the type of thickening agent and the desired degree of thickening.

The aqueous liquid washing and cleaning agents can contain enzymes in encapsulated form and/or directly in the washing- and cleaning-agent composition. Suitable enzymes are, in particular, those of the hydrolase classes, such as the proteases, esterases, lipases and lipolytically active enzymes, amylases, cellulases and other glycosyl hydrolases, and mixtures of the aforesaid enzymes. All these hydrolases contribute, in the laundry, to the removal of stains such as protein-, grease-, or starch-containing stains, and graying. Cellulases and other glycosyl hydrolases can moreover contribute to color retention and to enhanced textile softness by removing pilling and microfibrils. Oxidoreductases can also be used for bleaching and to inhibit color transfer. Enzymatic active substances obtained from bacterial strains or fungi, such as *Bacillus subtilis, Bacillus licheniformis, Streptomyceus griseus*, and *Humicola insolens*, are particularly suitable. Proteases of the subtilisin type, and in particular proteases obtained from *Bacillus lentus*, are preferably used. Enzyme mixtures, for example of protease and amylase or protease and lipase or lipolytically active enzymes, or protease and cellulase, or of cellulase and lipase or lipolytically active enzymes, or of protease, amylase, and lipase or lipolytically active enzymes, or protease, lipase or lipolytically active enzymes, and cellulase, but in particular protease- and/or lipase-containing mixtures or mixtures with lipolytically active enzymes, are of particular interest in this context. Examples of such lipolytically active enzymes are the known cutinases. Peroxidases or oxidases have also proven suitable in certain cases. The suitable amylases include, in particular, α-amylases, isoamylases, pullulanases, and pectinases. Cellobiohydrolases, endoglucanases, and β-glucosidases, which are also called cellobiases, and mixtures thereof, are preferably used as cellulases. Because different types of cellulase differ in terms of their CMCase and avicelase activities, the desired activities can be set by means of controlled mixtures of the cellulases.

The enzymes can be adsorbed onto carrier substances in order to protect them from premature breakdown. The proportion of enzymes, enzyme mixtures, or enzyme granulates directly in the washing- and cleaning-agent composition can be, for example, approximately 0.1 to 5 wt %, by preference 0.12 to approximately 2.5 wt %.

A large number of a very wide variety of salts from the group of the inorganic salts can be used as electrolytes. Preferred cations are the alkali and alkaline earth metals; preferred anions are the halides and sulfates. From the standpoint of production engineering, the use of NaCl or $MgCl_2$ in the agents is preferred. The proportion of electrolytes in the agents is usually 0.5 to 5 wt %.

Non-aqueous solvents that can be used in the liquid washing and cleaning agents derive, for example, from the group of the univalent or polyvalent alcohols, alkanolamines, or glycol ethers, provided they are miscible with water in the concentration range indicated. The solvents are by preference selected from ethanol, n- or isopropanol, butanols, glycol, propanediol or butanediol, glycerol, diglycol, propyl or butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl, or propyl ether, dipropylene glycol monomethyl or ethyl ether, diisopropylene glycol monomethyl or ethyl ether, methoxy-, ethoxy-, or butoxytriglycol, 1-butoxyethoxy-2-propanol, 3-methyl-3-methoxybutanol, propylene glycol t-butyl ether, and mixtures of these solvents. Non-aqueous solvents can be used in the liquid washing and cleaning agents in quantities between 0.5 and 15 wt %, but preferably below 12 wt % and in particular below 9 wt %.

In order to bring the pH of the liquid washing and cleaning agents into the desired range, the use of pH adjusting agents may be indicated. All known acids or bases are usable here, provided their use is not prohibited for environmental or applications-engineering reasons, or for consumer protection reasons. The quantity of these adjusting agents usually does not exceed 7 wt % of the total formula.

The liquid washing and cleaning agents can be colored with suitable dyes in order to improve their aesthetic impression. Preferred dyes, the selection of which will present no difficulty whatsoever to one skilled in the art, possess excellent shelf stability and insensitivity to the other ingredients of the agents and to light, and no pronounced substantivity with respect to textile fibers, in order not to color them.

Suitable foam inhibitors that can be used in the liquid washing and cleaning agents are, for example, soaps, paraffins, or silicone oils, which can be applied onto carrier materials as applicable.

Suitable soil release polymers, which are also referred to as "anti-redeposition agents," are, for example, nonionic cellulose ethers such as methyl cellulose and methylhydroxypropyl cellulose having a 15 to 30 wt % concentration of methoxy groups and a 1 to 15 wt % concentration of hydroxypropyl groups, based in each case on the nonionic cellulose ethers, as well as the polymers, known from the existing art, of phthalic acid and/or terephthalic acid or their derivatives, in particular polymers of ethylene terephthalates and/or polyethylene and/or polypropylene glycol terephthalates or anionically and/or nonionically modified derivatives thereof. Suitable derivatives encompass the sulfonated derivatives of the phthalic acid and terephthalic acid polymers.

Optical brighteners (so-called "whiteners") can be added to the liquid washing and cleaning agents in order to eliminate graying and yellowing of the treated textile fabrics. These substances are absorbed onto the fibers and cause a brightening and simulated bleaching effect by converting invisible ultraviolet radiation into visible longer-wave light; the ultraviolet light absorbed from sunlight is radiated as a weakly bluish fluorescence, combining with the yellow tint of the grayed or yellowed laundry to yield pure white. Suitable compounds derive, for example, from the substance classes of the 4,4'-diamino-2,2'-stilbenedisulfonic acids (flavonic acids), 4,4'-distyrylbiphenylene, methylumbelliferones, cumarins, dihydroquinolinones, 1,3-diarylpyrazolines, naphthalic acid imides, benzoxazole, benzisoxazole, and benzimidazole systems, and the pyrene derivatives substituted with heterocycles. The optical brighteners are usually used in quantities between 0.05 and 0.3 wt %, based on the complete agent.

The purpose of graying inhibitors is to keep dirt released from the fibers suspended in the bath, thus preventing the dirt from redepositing. Water-soluble colloids, usually organic in nature, are suitable for this, for example size, gelatin, salts of ethersulfonic acids of starch or cellulose, or salts of acid sulfuric acid esters of cellulose or starch. Water-soluble polyamides containing acid groups are also suitable for this purpose. Soluble starch preparations, and starch products other than those mentioned above, can also be used, e.g.

degraded starch, aldehyde starches, etc. Polyvinylpyrrolidone is also usable. It is preferred, however, to use cellulose ethers such as carboxymethyl cellulose (Na salt), methyl cellulose, hydroxyalkyl cellulose, and mixed ethers such as methylhydroxyethyl cellulose, methylhydroxypropyl cellulose, methylcarboxymethyl cellulose, and mixtures thereof, in quantities from 0.1 to 5 wt % based on the agents.

Because textile fabrics, in particular those made of rayon, viscose, cotton, and mixtures thereof, can tend to wrinkle because the individual fibers are sensitive to bending, kinking, compression, and squeezing transversely to the fiber direction, the agents according to the present invention can contain synthetic wrinkle-prevention agents. These include, for example, synthetic products based on fatty acids, fatty acid esters, fatty acid amides, fatty acid alkylol esters, fatty acid alkylolamides, or fatty alcohols that are usually reacted with ethylene oxide, or products based on lecithin or modified phosphoric acid esters.

In order to counteract microorganisms, the liquid washing and cleaning agents can contain antimicrobial active substances. A distinction is made here, in terms of the antimicrobial spectrum and mechanism of action, between bacteriostatics and bactericides, fungistatics and fungicides, etc. Important substances from these groups are, for example, benzalkonium chlorides, alkylarylsulfonates, halogen phenols, and phenol mercuric acetate; these compounds can also be entirely dispensed with in the agents according to the present invention.

The agents can contain antioxidants in order to prevent undesired changes, caused by the action of oxygen and other oxidative processes, to the liquid washing and cleaning agents and/or to the treated textile fabrics. This class of compounds includes, for example, substituted phenols, hydroquinones, catechols, and aromatic amines, as well as organic sulfides, polysulfides, dithiocarbamates, phosphites, and phosphonates.

Increased wearing comfort can result from the additional use of antistatic agents, which are additionally incorporated into the agents. Antistatic agents increase the surface conductivity and thus make possible improved dissipation of charges that have formed. External antistatic agents are usually substances having at least one hydrophilic molecule ligand, and yield a more or less hygroscopic film on the surfaces. These usually surface-active antistatic agents can be subdivided into nitrogen-containing (amines, amides, quaternary ammonium compounds), phosphorus-containing (phosphoric acid esters), and sulfur-containing antistatic agents (alkylsulfonates, alkyl sulfates). Lauryl (or stearyl) dimethylbenzylammonium chlorides are suitable as antistatic agents for textile fabrics or as an additive to washing agents, an avivage effect additionally being achieved.

In order to improve the water absorption capability and rewettability of the treated textile fabrics and to facilitate ironing of the treated textile fabrics, silicone derivatives, for example, can be used in the liquid washing and cleaning agents. These additionally improve the rinsing behavior of the agents as a result of their foam-inhibiting properties. Preferred silicone derivatives are, for example, polydialkyl- or alkylarylsiloxanes in which the alkyl groups have one to five carbon atoms and are entirely or partly fluorinated. Preferred silicones are polydimethylsiloxanes, which optionally can be derivatized and are then aminofunctional or quaternized or have Si—OH, Si—H, and/or Si—Cl bonds. The viscosities of the preferred silicones are in the range between 100 and 100,000 centistokes at 25° C.; the silicones can be used in quantities between 0.2 and 5 wt % based on the entire agent.

Lastly, the liquid washing and cleaning agents can also contain UV absorbers that are absorbed onto the treated textile fabrics and improve the light-fastness of the fibers. Compounds that exhibit these desired properties are, for example, the compounds that act by radiationless deactivation, and derivatives of benzophenone having substituents in the 2- and/or 4-position. Also suitable are substituted benzotriazoles, acrylates phenyl-substituted in the 3-position (cinnamic acid derivatives) optionally having cyano groups in the 2-position, salicylates, organic Ni complexes, and natural substances such as umbelliferone and endogenous urocanic acid.

Substances that complex heavy metals can be used in order to prevent the heavy-metal-catalyzed breakdown of certain washing-agent ingredients. Suitable heavy-metal complexing agents are, for example, the alkali salts of ethylenediaminetetraacetic acid (EDTA) or of nitrilotriacetic acid (NTA), as well as alkali-metal salts of anionic polyelectrolytes such as polymaleates and polysulfonates.

A preferred class of complexing agents is the phosphonates, which are contained in preferred liquid washing and cleaning agents in quantities from 0.01 to 2.5 wt %, by preference 0.02 to 2 wt %, and in particular 0.03 to 1.5 wt %. Included among these preferred compounds are, in particular, organophosphonates such as, for example, 1-hydroxyethane-1,1-diphosphonic acid (HEDP), amino tri(methylenephosphonic acid) (ATMP), diethylenetriamine penta(methylenephosphonic acid) (DTPMP or DETPMP), and 2-phosphonobutane-1,2,4-tricarboxylic acid (PBM-AM), which are usually used in the form of their ammonium or alkali-metal salts.

The aqueous liquid washing and cleaning agents that are obtained are by preference clear, i.e. they exhibit no sediment, and in particular are preferably transparent or at least translucent.

The washing and cleaning agents according to the present invention can be used to clean textile fabrics.

The liquid washing and cleaning agents are manufactured using known and usual methods and processes in which, for example, the constituents are simply mixed in agitator vessels; usefully, the water, non-aqueous solvent, and surfactant (s) are in place, and the further constituents are added in portions. Separate heating during manufacture is not necessary; if it is desired, the temperature of the mixtures should not exceed 80° C. According to the present invention, the method for manufacturing the liquid washing and cleaning agents encompasses the addition or use of aluminum silicate and silicic acid at a ratio from 1:10 to 10:1.

The capsules can be, for example, dispersed in stable fashion in the aqueous liquid washing and cleaning agents. "Stable" means that the agents are stable at room temperature and at 40° C. over a period of at least four weeks and preferably at least six weeks, with no creaming or sedimenting of the capsules.

Other than in the operating examples, where otherwise indicated, or where required to distinguish over the prior art, all numbers expressing quantities of ingredients or reaction conditions disclosed herein are to be understood as modified in all instances by the term "about". As used herein, the words "may" and "may be" are to be interpreted in an open-ended, non-restrictive manner. At minimum, "may" and "may be" are to be interpreted as definitively including, but not limited to, the composition, structure, or act recited.

As used herein, and in particular as used herein to define the elements of the claims that follow, the articles "a" and "an" are synonymous and used interchangeably with "at least one" or "one or more," disclosing or encompassing both the singular and the plural, unless specifically defined otherwise. The conjunction "or" is used herein in both in the conjunctive and disjunctive sense, such that phrases or terms conjoined by "or" disclose or encompass each phrase or term alone as well as any combination so conjoined, unless specifically defined otherwise.

The description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed.

Practical and preferred embodiments of the invention can be further illustrated by means of the following examples, which are not intended as limiting the invention. Changes in form and substitution of equivalents are contemplated as circumstances may suggest or render expedient. Although specific terms have been employed herein, such terms are intended in a descriptive sense and not for purposes of limitation.

EXAMPLES

Example 1

A variety of capsules K1 to K9 according to the present invention were manufactured and drip processed, with alginate as a matrix material, in a hardening bath using a Rieter drip processing unit. In addition, two capsules E1 and E2 not in accordance with the present invention were manufactured in the same fashion for comparison The respective alginate solutions had the compositions (in wt %) indicated in Table 1.

The hardening bath that was used contained 2.5 wt % $CaCl_2$, 0.05 wt % preservative, and water to make 100 wt %.

Table 2 shows washing and cleaning agents W1 to W4 according to the present invention. The washing and cleaning agents W1 to W4 that were obtained had a viscosity of about 1000 mPas. The pH of the liquid washing and cleaning agents was 8.5.

TABLE 2

| | W1 | W2 | W3 | W4 |
|---|---|---|---|---|
| Gellan gum | 0.2 | 0.2 | 0.15 | — |
| Xanthan gum | — | — | 0.15 | — |
| Polyacrylate (Carbopol Aqua 30) | 0.4 | 0.4 | — | 1.5 |
| $C_{12-14}$ fatty alcohol with 7 EO | 22 | 10 | 10 | 10 |
| $C_{9-13}$ alkylbenzenesulfonate, Na salt | — | 10 | 10 | 10 |
| $C_{12-14}$ alkyl polyglycoside | 1 | — | — | — |
| Citric acid | 1.6 | 3 | 3 | 3 |
| Phosphonic acid | 0.5 | 1 | 1 | 1 |
| Sodium lauryl ether sulfate with 2 EO | 10 | 5 | 5 | — |
| Monoethanolamine | 3 | 3 | 3 | — |
| $C_{12-18}$ fatty acid | 7.5 | 7.5 | 7.5 | 5 |
| Propylene glycol | — | 6.5 | 6.5 | 6.5 |
| Sodium cumene sulfonate | — | 2 | 2 | — |
| Boric acid | — | — | — | 1 |
| Defoamer | 0.3 | 0.3 | 0.3 | 0.3 |
| Enzymes, dyes, stabilizers | + | + | + | + |
| K6 capsules approx. 2000 μm diam. | 0.5 | 0.5 | 0.5 | 0.5 |
| Water to make | 100 | 100 | 100 | 100 |

The K6 capsules were introduced without difficulty into the washing and cleaning agents. In particular, no clouding of the washing and cleaning agents W1 to W4 occurred.

Example 2

Washing tests were performed using washing and cleaning agent W4, which contained 0.5 wt % capsules. The washing tests were performed using an AEG washing machine (Öko-Lavamat 88840) utilizing the wool cycle with a 2 kg load. The load was made up of assembled items made of cotton and mixed fabrics of cotton with, for example, microfibers, elastan, polyamide, polyester, and/or viscose, as well as yard goods pieces of cotton or a polyamide-elastan mix. The washed items were then examined for any residues, and evaluated with a score from 1 to 6, a score of 1 (=no residues) being the best.

TABLE 1

| | K1 | K2 | K3 | K4 | K5 | K6 | K7 | K8 | K9 | E1 | E2 |
|---|---|---|---|---|---|---|---|---|---|---|---|
| Sodium alginate | 1 | 0.9 | 0.8 | 0.6 | 0.95 | 0.95 | 0.95 | 0.95 | 1 | 1 | 1 |
| Wessalith ® 4000 | 1 | 2 | 3 | 4 | 3 | 3 | 3 | 3 | 3 | — | 5 |
| Sipernat ® 22S | 3 | 3 | 3 | 3 | 3 | 3 | 3 | 3 | 3 | 3 | — |
| Hollow microspheres[1] | 4 | 4 | 4 | 4 | 4 | 3.5 | 4 | 4 | 3.5 | 4 | 5 |
| Preservative | 0.05 | 0.05 | 0.05 | 0.05 | 0.05 | 0.05 | 0.05 | 0.05 | 0.05 | 0.05 | 0.05 |
| Dye | 0.1 | 0.1 | 0.1 | 0.1 | 0.1 | 0.1 | 0.1 | 0.1 | 0.1 | 0.1 | 0.2 |
| Cellulase | 1 | 1 | 1 | 1 | — | — | — | — | — | 1 | — |
| Cellulose | 1 | 1 | 1 | 1 | — | — | — | — | — | 1 | — |
| Marloquest ® L 235 M | — | — | — | — | — | 1 | — | — | — | — | — |
| SRP Repellotex ® 6 | — | — | — | — | — | — | 0.5 | — | — | — | — |
| Präpagen ® HY | — | — | — | — | 0.5 | — | — | | — | — | 1 |
| Sokalan ® HP 56 | — | — | — | — | — | — | — | 1 | — | — | — |
| Tinopal ® UNPA | — | — | — | — | — | — | — | — | 1 | — | — |
| Water to make | 100 | 100 | 100 | 100 | 100 | 100 | 100 | 100 | 100 | 100 | 100 |

[1]Hollow ceramic microspheres having a diameter in the range from 10 to 125 μm and a density in the range from 0.5 to 0.7 $g \cdot cm^{-3}$.

TABLE 3

| Capsules in washing agent | K1 | K2 | K3 | K4 | E1 | E2 |
|---|---|---|---|---|---|---|
| Test 1 | | | | | | |
| Avg. score | 1.1 | 1.0 | 1.0 | 1.0 | 1.1 | 1.2 |
| Lowest score | 1 | 1 | 1 | 1 | 1 | 1 |
| Highest score | 2 | 1 | 1 | 1 | 2 | 2.5 |
| Test 2 | | | | | | |
| Avg. score | 1.0 | 1.0 | 1.0 | 1.0 | 1.1 | 1.1 |
| Lowest score | 1 | 1 | 1 | 1 | 1 | 1 |
| Highest score | 1 | 1 | 1 | 1 | 2 | 2 |

It is evident from Table 3 that capsules K1 to K4 according to the present invention exhibited improved solubility characteristics as compared with capsules E1 and E2. Capsules K2 to K4, in particular, dissolved without residue in all the washing tests.

Capsules K5 to K9 also exhibited improved solubility characteristics as compared with comparison capsules E1 and E2

What is claimed:

1. An aqueous liquid washing or cleaning agent comprising a surfactant and least one capsule, the capsule comprising, encapsulated in a matrix, an active ingredient, an aluminum silicate, and a silicic acid, the aluminum silicate and the silicic acid being present in the matrix in a ratio from 1:10 to 10:1.

2. The aqueous liquid washing or cleaning agent of claim 1, wherein the aluminum silicate and the silicic acid are present at a ratio from 1:4 to 4:1.

3. The aqueous liquid washing or cleaning agent of claim 2, wherein the aluminum silicate and the silicic acid are present at a ratio from 2:3 to 4:3.

4. The aqueous liquid washing or cleaning agent of claim 1, wherein the active ingredient is one or more selected from the group consisting of optical brighteners, surfactants, complexing agents, bleaching agents, bleach activators, dyes, fragrances, antioxidants, detergency builders, enzymes, enzyme stabilizers, antimicrobial active substances, graying inhibitors, anti-redeposition agents, pH adjusting agents, soil release polymers, color transfer inhibitors, electrolytes, conditioning oils, abrasive material, skin-care agents, foam inhibitors, vitamins, proteins, preservatives, washing power intensifiers, luster agents, and UV absorbers.

5. The aqueous liquid washing or cleaning agent of claim 1, wherein the capsule further comprises at least one hollow microsphere.

6. The aqueous liquid washing or cleaning agent of claim 1, wherein the matrix comprises one or more materials selected from the group consisting of carrageenan, alginate, and gellan gum.

7. The aqueous liquid washing or cleaning agent of claim 1, wherein the capsule has a diameter from 0.01 to 10,000 μm along its greatest physical extension.

8. A method of cleaning a textile fabric comprising the steps of contacting a textile fabric with a cleaning-effective amount of a liquid washing or cleaning agent, the agent comprising a surfactant and least one capsule, the capsule comprising, encapsulated in a matrix, an active ingredient, an aluminum silicate, and a silicic acid, the aluminum silicate and the silicic acid being present at a ratio from 1:10 to 10:1.

9. The method of claim 8, wherein the aluminum silicate and the silicic acid are present at a ratio from 1:4 to 4:1.

10. The method of claim 9, wherein the aluminum silicate and the silicic acid are present at a ratio from 2:3 to 4:3.

11. The method of claim 8, wherein the capsule further comprises at least one hollow microsphere.

12. The method of claim 8, wherein the active ingredient is one or more selected from the group consisting of optical brighteners, surfactants, complexing agents, bleaching agents, bleach activators, dyes, fragrances, antioxidants, detergency builders, enzymes, enzyme stabilizers, antimicrobial active substances, graying inhibitors, anti-redeposition agents, pH adjusting agents, soil release polymers, color transfer inhibitors, electrolytes, conditioning oils, abrasive material, skin-care agents, foam inhibitors, vitamins, proteins, preservatives, washing power intensifiers, luster agents, and UV absorbers.

13. The method of claim 8, wherein the matrix comprises one or more materials selected from the group consisting of carrageenan, alginate, and gellan gum.

14. A method of manufacturing an aqueous liquid washing or cleaning agent, comprising combining a surfactant and at least one capsule, wherein the capsule is formed by encapsulating in a matrix an active ingredient, an aluminum silicate, and a silicic acid, wherein the aluminum silicate and the silicic acid are present in the matrix in a ratio from 1:10 to 10:1.

15. The method of claim 14, wherein the aluminum silicate and the silicic acid are present at a ratio from 1:4 to 4:1.

16. The method of claim 15, wherein the aluminum silicate and the silicic acid are present at a ratio from 2:3 to 4:3.

17. The method of claim 14, wherein the active ingredient is one or more selected from the group consisting of optical brighteners, surfactants, complexing agents, bleaching agents, bleach activators, dyes, fragrances, antioxidants, detergency builders, enzymes, enzyme stabilizers, antimicrobial active substances, graying inhibitors, anti-redeposition agents, pH adjusting agents, soil release polymers, color transfer inhibitors, electrolytes, conditioning oils, abrasive material, skin-care agents, foam inhibitors, vitamins, proteins, preservatives, washing power intensifiers, luster agents, and UV absorbers.

18. The method of claim 14, wherein the capsule further comprises at least one hollow microsphere.

19. The method of claim 14, wherein the matrix comprises one or more materials selected from the group consisting of carrageenan, alginate, and gellan gum.

20. A liquid detergent comprising a capsule, said capsule comprising, encapsulated in a matrix, an active ingredient, an aluminum silicate, and a silicic acid, wherein the matrix comprises the aluminum silicate and the silicic acid in a ratio from 1:10 to 10:1.

21. The liquid detergent of claim 20, wherein the active ingredient is one or more selected from the group consisting of optical brighteners, surfactants, complexing agents, bleaching agents, bleach activators, dyes, fragrances, antioxidants, detergency builders, enzymes, enzyme stabilizers, antimicrobial active substances, graying inhibitors, anti-redeposition agents, pH adjusting agents, soil release polymers, color transfer inhibitors, electrolytes, conditioning oils, abrasive material, skin-care agents, foam inhibitors, vitamins, proteins, preservatives, washing power intensifiers, luster agents, and UV absorbers.

22. The liquid detergent of claim 20, wherein the aluminum silicate and the silicic acid are present at a ratio from 1:4 to 4:1.

23. The liquid detergent of claim 21, wherein the aluminum silicate and the silicic acid are present at a ratio from 2:3 to 4:3.

24. The liquid detergent of claim 20, wherein the capsule further comprises at least one hollow microsphere.

25. The liquid detergent of claim 20, wherein the matrix comprises one or more materials selected from the group consisting of carrageenan, alginate, and gellan gum.

* * * * *